United States Patent [19]

Toevank et al.

[11] Patent Number: 4,486,922

[45] Date of Patent: Dec. 11, 1984

[54] APPARATUS FOR SEPARATING IMPURITIES FROM FIBER MATERIAL

[75] Inventors: Berend J. Toevank, TL Losser; Hendrik J. H. Hobbelt, BK Almelo, both of Netherlands

[73] Assignee: Trützschler GmbH & Co. KG, Monchen-Gladbach, Fed. Rep. of Germany

[21] Appl. No.: 397,403

[22] Filed: Jul. 12, 1982

[30] Foreign Application Priority Data

Jul. 11, 1981 [DE] Fed. Rep. of Germany ..... 3127418

[51] Int. Cl.[3] ..... D01G 9/12

[52] U.S. Cl. ..... 19/200; 19/80 R; 19/105; 19/107; 19/202

[58] Field of Search ..... 19/105, 107, 200, 202, 19/204, 205, 80 R, 81

[56] References Cited

U.S. PATENT DOCUMENTS

| | | | |
|---|---|---|---|
| 2,166,925 | 7/1939 | Mitchell et al. | 209/241 |
| 3,205,538 | 9/1965 | Miller et al. | 19/204 |
| 3,315,320 | 4/1967 | Bass et al. | 19/107 |
| 3,387,337 | 6/1968 | Crowley | 19/107 |
| 4,064,598 | 12/1977 | Katoh et al. | 19/105 |
| 4,135,275 | 1/1979 | Gunter et al. | 19/107 |
| 4,345,356 | 8/1982 | Handschuch et al. | 19/105 X |
| 4,346,500 | 8/1982 | Demuth | 19/105 |
| 4,355,439 | 10/1982 | Estebanell | 19/105 |
| 4,379,357 | 4/1983 | Beneke et al. | 19/105 |

FOREIGN PATENT DOCUMENTS

| | | |
|---|---|---|
| 2606193 | 9/1976 | Fed. Rep. of Germany . |
| 2743187 | 3/1978 | Fed. Rep. of Germany . |
| 2932562 | 2/1981 | Fed. Rep. of Germany . |

*Primary Examiner*—Louis K. Rimrodt

*Attorney, Agent, or Firm*—Spencer & Frank

[57] ABSTRACT

Apparatus for separating impurities from fiber material, composed of: a cylinder provided on its circumference with clothing and connected to be rotated in a selected direction for gripping and transporting fiber material, a feed device disposed for feeding fiber material containing impurities to the cylinder, the feed device cooperating with the cylinder to define a feed path presenting a constriction at the location of the cylinder, a blocking element disposed in the path at the location of the constriction opposite the cylinder, and elements for delivering a stream of air and filter material along the path toward the constriction to be intercepted by the blocking element, while the cylinder is rotating, for causing the fiber material to be gripped by the clothing, and causing the air and impurities removed from the fiber material to flow through the blocking element and to be carried off from the region of the constriction.

14 Claims, 6 Drawing Figures

APPARATUS FOR SEPARATING IMPURITIES FROM FIBER MATERIAL

BACKGROUND OF THE INVENTION

The present invention relates to an apparatus for separating impurities, such as dust, dirt and the like, from fiber material, particularly cotton, the apparatus including a clothed roller disposed behind a feeding device for gripping and further transporting the fiber material. In apparatus of this type, a condenser serves to effect a separation of air and cotton at the end of a tubular conduit. It has been found that this simultaneously removes dust from the cotton.

The major components of any condenser are a fan and a screen drum, the latter rotating so as to continuously offer a new screen surface to the stream of air laden with cotton. The lap or cotton wool collected on the screen drum must then be removed again immediately from the drum so that the screen surfaces remain fully receptive. The condenser has three openings: one for the influx of the material to be cleaned; one for removal of the cleaned cotton; and one for the removal of the air and the dust.

Suction is produced within the drum so that the fiber material is pulled to the outer jacket of the drum where the lap is formed. The suction pull imparts a certain increase in density to the web so that dust removal is made more difficult.

SUMMARY OF THE INVENTION

It is an object of the present invention to improve an apparatus of this type to the extent that the degree of dust removal is increased considerably.

The above and other objects are achieved, according to the present invention, by the provision of apparatus for separating impurities from fiber material, composed of: a cylinder provided on its circumference with clothing and connected to be rotated in a selected direction for gripping and transporting fiber material; means defining a feed device disposed for feeding fiber material containing impurities to the cylinder, the feed device cooperating with the cylinder to define a feed path presenting a constriction at the location of the cylinder; a blocking element disposed in the path at the location of the constriction opposite the cylinder; and means for delivering a stream of air and filter material along the path toward the constriction to be intercepted by the blocking element, while the cylinder is rotating, for causing the fiber material to be gripped by the clothing, and causing the air and impurities removed from the fiber material to flow through the blocking element and to be carried off from the region of the constriction.

The fiber material may be supplied to the clothed cylinder of such apparatus in the form of fiber tufts or as fibers. The supplying may be effected pneumatically, e.g. through a tubular conduit, or mechanically by way of rolls or through troughs. The stream of air here plays a significant part.

In the case of pneumatic transport, the fiber material enters the region of the blocking element and of the clothed cylinder together with the stream of transporting air. At least part of the fiber material impinges on the blocking element. While the transporting air and the impurities flow through the blocking element, the fiber material is gripped by the teeth, pins or the like of the clothed cylinder and is transported away immediately. Since the fiber material flows toward a portion of the cylinder which is moving in a direction opposite to the direction of movement of the fiber stream, part of the fiber material can already be caught directly by the clyinder out of the stream of air and carried along. If the circumferential velocity of the clothed cylinder is high enough, a draft may occur when the fiber material impinges. The draft reduces the number of fibers per cross section. Such drawing is used to stretch the fibers and arrange them in a parallel orientation.

The teeth of the clothed cylinder may here pull individual fibers out of fiber tufts supplied in the stream of air or thrown against the blocking element.

In the case of transporting by means of rolls or trays, the fiber material is mechanically conveyed to the region of the blocking element and of the clothed cylinder in a mechanical manner. in this region, a stream of air acts on the fiber material, by flowing through the fiber material, and moves it in the direction toward the blocking element.

The fiber material in this area may be present in the form of fiber tufts, individual fibers or a mixture of both. The greater the break-up into individual fibers, the better is the dust removal effect. The blocking element is designed in such a manner that only dust, fragments of impurities and short fibers can penetrate through the interstices, while fiber tufts and good fibers are retained.

In contrast to a condenser, there is no increase in density of the fiber material into a lap. Rather, the fiber tufts are removed immediately by the clothed cylinder, preferably while further dividing the fiber tufts into individual fibers, thus producing an effective separation of dust, fragments, impurities and short fibers.

In order to achieve a directed supply of the fiber material, a gap is present in the region of the convergence of the feeding device and of the clothed cylinder. Preferably, the blocking element includes a clothing, sawteeth, needles or the like, constituting an element presenting a plurality of projections through whose interstices only dust, impurity fragments and short fibers can penetrate.

Advisably, the elements of the clothing, sawteeth, needles or the like are arranged to be laterally offset with respect to one another so as to produce an effective block against the penetration and intrusion of the fiber material, including the fiber tufts and good fibers. According to a particularly preferred embodiment, the blocking element is disposed in a recess of the wall opposite the clothing. This increases the flow cross section for the stream of air which removes the impurities. The resistance presented to the stream of air is reduced by the increase in cross section so that lower fan power for the air stream is sufficient. The resistance offered by the clothing, sawteeth, needles or the like disposed within the recess with respect to the stream of air is relatively low.

Preferably, the blocking element is arranged in a stationary manner with the tips of the sawteeth, needles or the like being disposed opposite the tips of the cylinder clothing. It may also be advisable to provide the blocking element in the form of a slowly rotating work roll whose direction of rotation is opposite to, or advantageously the same as, the direction of rotation of the clothed cylinder.

Advantageously, the fiber material is supplied pneumatically by the use of compressed air, suction, or both. The conveyance takes place without any point of restriction, i.e. in a free stroke of air.

While in a free stroke of air the fibers drop onto the clothing of the opening cylinder, for example pneumatically or by gravity, in contrast thereto, in the so-called fast-hold stroke, the fibers are fed to the opening cylinder through a feeding device, for example in the form of a feed cylinder having a feed table.

Alternatively, it may be advisable for the fiber material to be supplied by means of rolls, e.g. two rolls, or by way of tray feeding, involving a feed roll with a feed table. This type of conveyance presents a point of restriction.

Advisably, the fiber material, if it is conveyed pneumatically, is conveyed by means of compressed air and, if it is conveyed mechanically, it is supplied with compressed air. In the latter case, an additional stream of air may act on the mechanical conveying device. Preferably, the stream of air is extracted together with the impurities by suction air.

The apparatus according to the invention can be employed, for example, in conjunction with an opener, cleaner, carding machine or the like in a cleaning train.

The invention will now be explained in greater detail with the aid of embodiments that are illustrated in the drawings.

DESCRIPTION OF THE PREFERRED EMBODIMENTS

Figure 1:
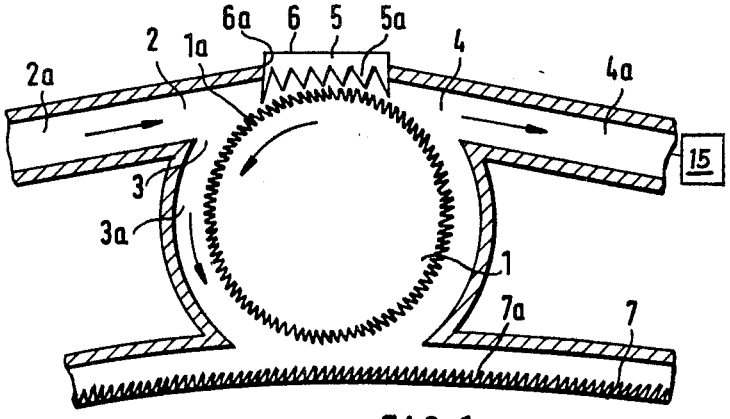
FIG. 1 is a simplified elevational view of a preferred embodiment of an apparatus according to the invention.

As shown in FIG. 1, cylinder 1 provided with clothing is rotatably mounted and driven counterclockwise to continuously offer a new clothing surface to a stream of air charged with cotton. The housing around the clothed cylinder 1 has three openings 2, 3 and 4; the opening 2 is for the influx of the mixture of air and cotton, opening 3 for the removal of the cleaned cotton, and opening 4 for the removal of the air and the dust. Opening 2 is at the outlet end of a channel 2*a* connected to a tuft feeding device (not shown). Opening 4 is at the inlet end of a channel 4*a* connected to a suction fan 15.

Figure 2A:
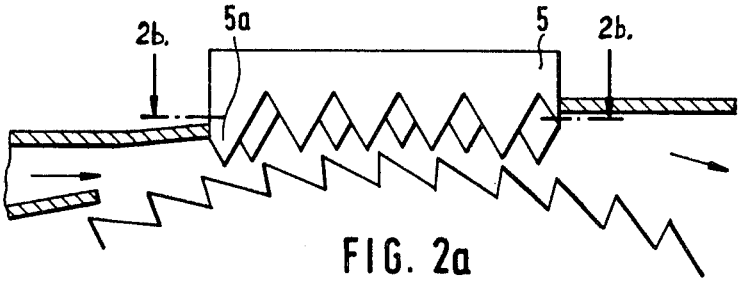
FIG. 2*a* is a detail elevational view of the blocking element of the embodiment of FIG. 1.
Figure 2B:
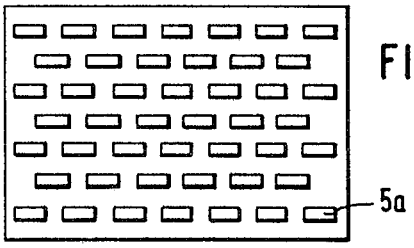
FIG. 2*b* is a cross-sectional detail plan view, along line 2*b*—2*b* of FIG. 2*a*, of the clothing of the blocking element of FIG. 2*a*.

The feeding device, i.e. channel 2*a*, and the clothed cylinder 1, together define a region of convergence, or a constriction, in which a blocking element 5 is provided opposite the clothing 1*a*. The blocking element 5 has a clothing 5*a* whose teeth are arranged to be laterally offset with respect to one another, as can clearly be seen in FIGS. 2*a* and 2*b*. The blocking element 5 is fixed in a recess 6*a* of the wall 6 opposite the clothing 1*a*.

During operation, fiber material, e.g. in the form of fiber tufts, is supplied pneumatically through channel 2*a* (see arrow). The stream of air impinges on the blocking element 5, which intercepts at least part of the fiber material. Thus is causes the fiber material to be gripped by the clothing 1*a* of the clothed cylinder 1 and transported into channel 3*a* at whose end it is removed by the clothing 7*a* of a further clothed cylinder 7. The stream of air with the separated impurities flows between the teeth of clothing 5*a* of the blocking element 5 and is then removed through channel 4*a* in the direction shown by the arrow.

Figure 3:
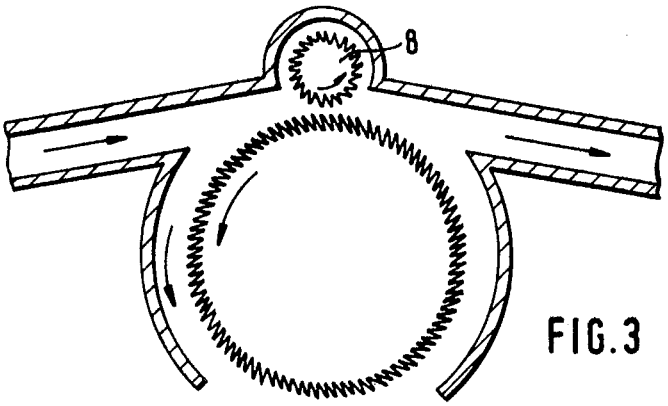
FIG. 3 is a view similar to that of FIG. 1 of another embodiment of an apparatus according to the invention having a work roll as the blocking element in a recess.

In the embodiment shown in FIG. 3, the blocking element is a slowly rotating clothed work roll 8 which rotates counterclockwise.

Figure 4:
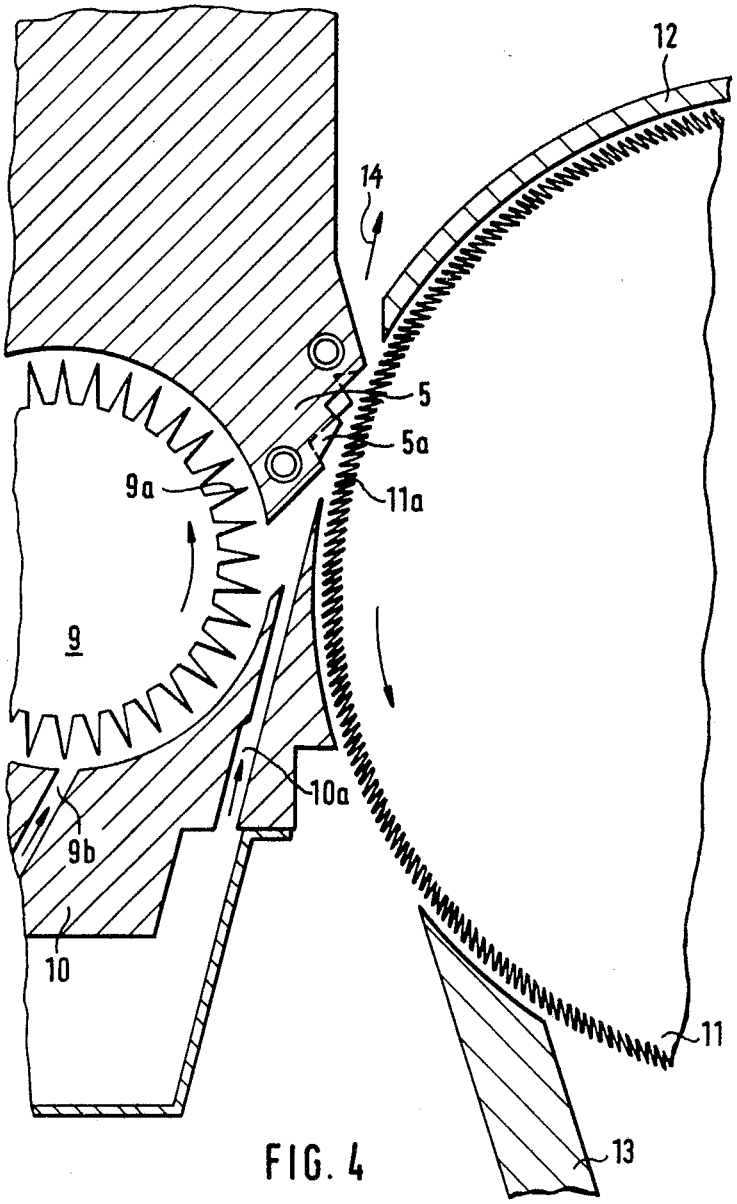
FIG. 4 is a simplified elevational view of another embodiment of apparatus according to the invention in the region of the intake of a carding machine for processing individual fibers and/or fine fiber tufts.

FIG. 4 shows the intake region of a carding machine (not shown in detail) including a feed cylinder 9, a feed table 10 and a lickerin 11 with cover 12 and blade 13. The feed roller 9 is equipped with a clothing composed of needles 9*a* and rotates counterclockwise if the fiber material is supplied from below the feed roller 9 along table 10 and clockwise if the fiber material is supplied at the top of the feed roller. The feed table 10 is provided with an air channel 10*a* which has one end connected to a source of compressed air (not shown) and which opens at its other end into the region between feed cylinder 9 and lickerin 11.

Above the channel 10*a*, between the feed cylinder 9 and the lickerin 11, there is provided the blocking element 5 whose clothing 5*a* faces the clothing 11*a* of the lickerin 11. The clothing 5*a* is sloped so that it directs the fiber material in the direction toward the clothing 11*a*. On the side of the feed table 10 facing away from the blocking element there is disposed a source of suction air (not shown).

The fiber material is conveyed by the needles 9*a* of the feed cylinder 9 into the region between the feed cylinder 9, the blocking element 5, the lickern 11 and the feed table 10. The feed roller 9 has an associated compressed air channel 9*b* which blows additional air onto the fiber material in the direction of roller 9. This stream of air is oriented approximately in the direction toward the blocking element 5. The fiber material, which is substantially broken up into individual fibers, is charged with compressed air through channel 10*a*; this stream of air loosens the dust out of the fiber material, flows through the clothing 5*a* of the blocking element and is then extracted in the direction of arrow 14. The individual fibers are gripped by the clothing 11*a* of the lickerin 11 and are carried along counterclockwise around the edge of the feed table 10.

Figure 5:
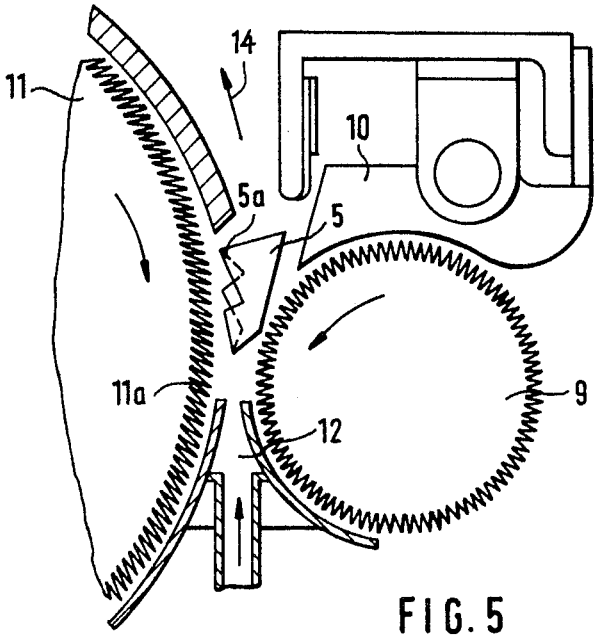
FIG. 5 is a view similar to that of FIG. 4 of another embodiment of apparatus according to the invention in the region of the intake of a carding machine for processing fiber tufts and/or fibers.

FIG. 5 shows the intake region of a carding machine in which the feed cylinder 9 rotates counterclockwise and the lickerin 11 rotates clockwise. The fiber material is supplied from the top, via a feed table 10, past the rear side of blocking element 5 and then into the region between the lickerin 11, the blocking element 5, the feed cylinder 9 and a nozzle 12 for supplying compressed air. The stream of compressed air leaving the nozzle 12 penetrates the fiber tufts (not shown), flows through the clothing 5*a* of the blocking element 5 and is extracted together with the impurities such as dust, dirt and the like, by means of a source of suction air (not shown), in the direction of arrow 14. The fiber tufts are carried along and transported away in a known manner by the clothing 11*a* of the lickerin 11. The clothing 11*a*, the feed cylinder 9 and the feed table 10 are disclosed, for example, in U.S. Pat. No. 3,205,538.

It will be understood that the above description of the present invention is susceptible to various modifications, changes and adaptations, and the same are intended to be comprehended within the meaning and range of equivalents of the appended claims.

What is claimed is:

1. Apparatus for separating impurities from fiber material, comprising: a cylinder provided on its circumference with clothing and connected to be rotated in a selected direction for gripping and transporting fiber material; means defining a feed device disposed for feeding fiber material containing impurities to said cylinder, said feed device cooperating with said cylinder to define a feed path presenting a constriction at the location of said cylinder; a blocking element disposed in said path at the location of said constriction opposite said cylinder for intercepting at least part of the fiber material; and means for delivering a stream of air and fiber material along said path toward said constriction to be intercepted by said blocking element, while said cylinder is rotating, for causing the fiber material to be gripped by said clothing, and causing the air to pass through said constriction and, with impurities removed from the fiber material, to flow through said blocking element and to be carried off from the region of said constriction.

2. Apparatus as defined in claim 1 wherein said constriction has the form of a gap.

3. Apparatus according to claim 1 wherein said blocking element comprises an element presenting a plurality of projections extending toward said cylinder.

4. Apparatus according to claim 3 wherein said projections are laterally offset with respect to one another transverse to the direction of the path.

5. Apparatus according to claim 1 wherein said feed device comprises a wall delimiting said path and presenting a recess disposed opposite said cylinder, and said blocking element is housed in said recess.

6. Apparatus according to claim 1 wherein said blocking element is stationary.

7. Apparatus according to claim 1 wherein said blocking element is a work roll driven to rotate slowly.

8. Apparatus according to claim 1 wherein said feed device operates to convey the fiber material pneumatically.

9. Apparatus according to claim 1 wherein said feed device comprises a feed cylinder and an associated feed table.

10. Apparatus according to claim 1 wherein said feed device comprises means for conveying the fiber material with the aid of compressed air.

11. Apparatus according to claim 1 further comprising a suction source for extracting the air and impurities from the region of said blocking element.

12. Apparatus according to claim 1 further comprising means presenting compensating openings for at least partly decoupling the region where said clothing grips the fiber material and the region adjacent said cylinder where air and impurities are removed so that, from an aerodynamic point of view, those regions are practically independent.

13. Apparatus as defined in claim 1, wherein said blocking element comprises clothing facing said cylinder.

14. Apparatus as defined in claim 1, wherein the air and impurities are carried off in substantially the same direction as the flow of the stream of air toward said constriction.

* * * * *